United States Patent [19]

Praitoni et al.

[11] 4,367,784

[45] Jan. 11, 1983

[54] METHOD FOR ADDING COOLING POWDERS TO STEEL DURING CONTINUOUS CASTING

[75] Inventors: Alberto Praitoni; Antonio Spaccarotella, both of Rome, Italy

[73] Assignee: Centro Sperimentale Metallurgico S.p.A., Rome, Italy

[21] Appl. No.: 895,851

[22] Filed: Apr. 12, 1978

[30] Foreign Application Priority Data

Apr. 18, 1977 [IT] Italy ..... 49007 A/77

[51] Int. Cl.[3] ..... B22D 11/10

[52] U.S. Cl. ..... 164/473; 164/475

[58] Field of Search ..... 164/57, 86, 473, 475

[56] References Cited

U.S. PATENT DOCUMENTS

| | | | |
|---|---|---|---|
| 3,592,363 | 7/1971 | Stout | 164/57 |
| 3,886,992 | 6/1975 | Mass et al. | 164/57 |

FOREIGN PATENT DOCUMENTS

| | | | |
|---|---|---|---|
| 751294 | 1/1967 | Canada | 164/425 |
| 537204 | 6/1941 | United Kingdom | 164/57 |
| 1013077 | 12/1965 | United Kingdom | 164/57 |

OTHER PUBLICATIONS

"The German Printed Publication", No. 2,329,953, Jan., 1975.

"The German Printed Publication", No. 2,321,847, Nov., 1974.

*Primary Examiner*—Gus T. Hampilos

*Assistant Examiner*—K. Y. Lin

*Attorney, Agent, or Firm*—Young & Thompson

[57] ABSTRACT

Steel powders are added to steel in a stream of inert gas introduced into the ladle above the casting mold, at a point near the exit of the steel from the ladle. The powders are thus entrained in the metal entering the mold and dissolve therein. The lance that injects the powders may also plug the ladle outlet. The powders can be used not only to perform their cooling function but also to introduce alloying elements.

1 Claim, 1 Drawing Figure

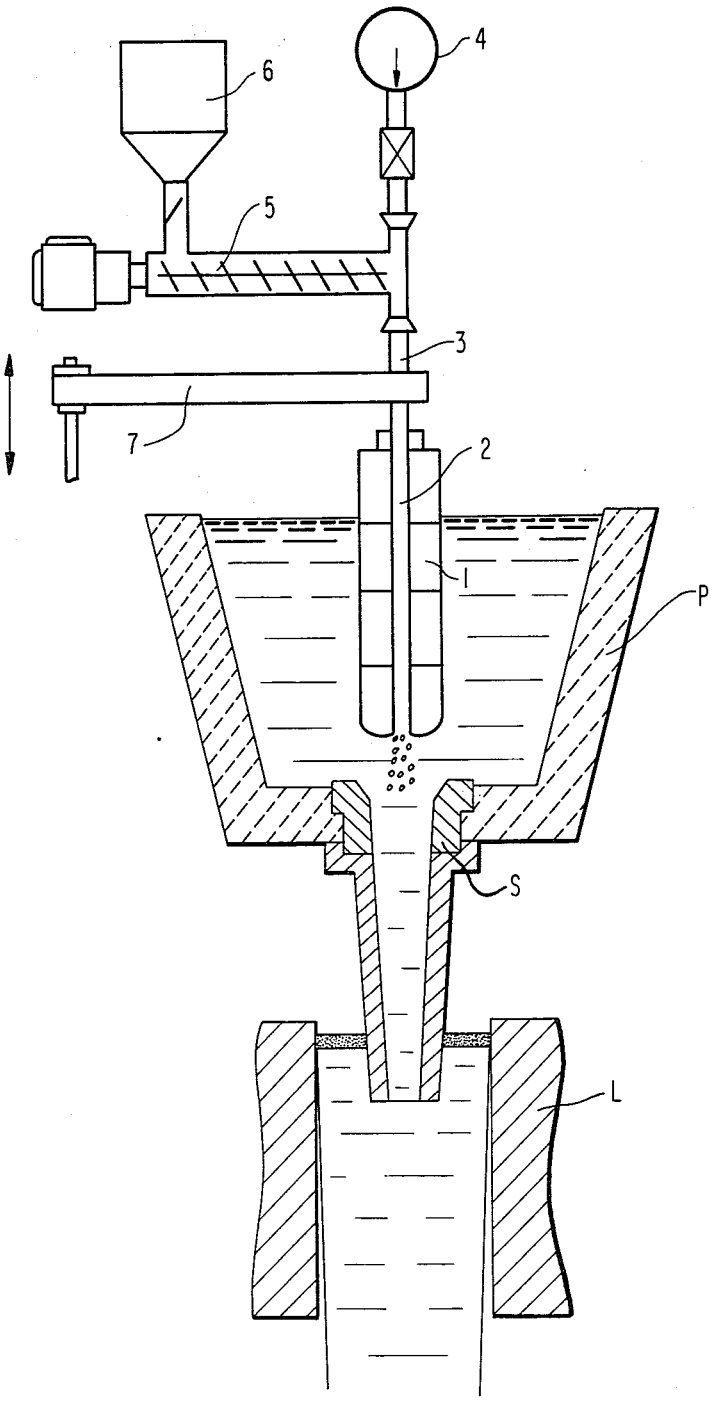
4
6
5
3
7
2
1
P
S
L

METHOD FOR ADDING COOLING POWDERS TO STEEL DURING CONTINUOUS CASTING

The present invention relates to a method for adding cooling powders to steel during continuous casting, using a pneumatic transport system capable of protecting the powders from attack by oxygen pick-up. More precisely, it relates to the addition of powders (preferably metal powders) to the steel in the mold for the purpose of improving overall process temperature control; the latter, as is well-known, has a marked positive influence on both plant productivity and product quality.

It has been ascertained that the casting rate can be increased (and, consequently, the risk diminished of defects arising from inadequate ingot temperature control, for example breakouts) by adding solid particles to the molten steel.

According to the present invention the grain size and feed rate of the cooling powder are assigned critical values, the combination of which makes the following operations possible.

- injection of cooling powder into an inert gas stream and pneumatic transport of powder by the gas stream through a ducted device to a point nearby the dispenser outlet;
- dispersal of powder in the liquid steel by bubbling a gas stream through the steel bath near the dispenser outlet;
- dissolution of the powder in the molten steel in the mold.

The amount of cooling powder injected may vary from 0.5% to 3% of the weight of the steel to be cast. The grain size of the cooling powder may vary from 0.02 mm to 3.0 mm.

The only specific requirement of the carrier gas is that it must not react either with the powder or with the steel bath. Argon, nitrogen and a combination of these two gases have all given good results in this connection. The carrier gas/powder ratio may vary from 1 liter to 30 liters of gas per kilogram of powder. Up to this point, only the cooling effect of the powder has been considered; it should also be emphasized, however, that the powder added according to this invention to the steel being cast can be used for alloying purposes.

Thus, for a powder which is used only for cooling purposes, the powder composition is preferably close to that of the steel that is being cast, except that the carbon content of the powder should be such as to impart to the powder a melting point lower than that of the steel that is being cast, in order to ensure melting of the powder. A powder which, in addition to its cooling function, also performs an alloying function, can have the same composition as a powder which performs purely a cooling function, plus an important quantity of the alloying element to be introduced via the powder, for example: 2% of aluminum, titanium, niobium, etc.

The invention covers the device used for practicing the method, as well as the method itself. Essentially, the device consists of the following functional units:

- A rod to plug the dispenser discharge outlet, provided with an internal duct along its entire length which forms part of the system for conveying, by pneumatic transport, the powder into the steel.
- Equipment for injecting the powder into the duct mentioned above and for its pneumatic transport.

- Equipment for supplying the carrier gas used for pneumatic transport of the powder.

With reference to the drawing, the purposes, characteristics and advantages of the present invention will now be described in more detail (purely as a non-limitative example).

The drawing shows the longitudinal cross-section of a particular embodiment of the device forming the subject of this invention.

A rod 1 is used to plug the dispenser discharge nozzle S of a continuous casting plant container in the form of a ladle or tundish P and is provided with an internal duct 2 which serves as the path for pneumatic transport of a powder susceptible to oxidation. The upper end of rod 1 is connected to a piping system 3 which is fed with carrier gas by a blower 4 and with the powder to be added to the bath by a batch feeder 5 that receives the powder from a hopper 6. The device is adjustably vertically positioned by an operating control arm 7, by which the height of the lower end of rod 1 above the outlet of the ladle P to nozzle S can be adjusted thereby to vary the flow rate of molten steel out of the ladle. When rod 1 is fully lowered, its lower end seats in the outlet to close the outlet, whereby rod 1 functions as a valve to alter the molten steel flow rate and even to shut it off entirely.

In order to enable those skilled in this art to practice the invention, the following examples are given:

EXAMPLE I

A ladle having a capacity of 80 tons is maintained with an average content of 75 tons of steel having the following weight percent composition:

| | |
|---|---|
| Carbon | 0.4% |
| Silicon | 0.4% |
| Manganese | 1.0% |
| Phosphorous | 0.025% |
| Sulfur | 0.010% |
| Nickel | 0.1% |
| Chromium | 1.0% |
| Molybdenum | 0.03% |
| Copper | 0.1% |
| Aluminum | 0.012% |
| Balance essentially iron | |

The molten steel in the ladle is continuously replenished from a tundish strand at a rate of 200 kg/min, and flows from the ladle outlet or nozzle into the continuous casting mold at the same rate. The casting mold produces a bar shaped casting 280 mm. thick, in an entirely conventional manner. The rod 1 is adjusted in elevation by control arm 7, to that point above discharge nozzle S at which the flow out of the ladle will be at the same rate as the flow into the ladle, whereby a continuous process is practiced.

The lower end of internal duct 2, that is, its outlet end at the lower end of rod 1, is circular and has a diameter of 10 mm. Gaseous argon is supplied by blower 4 to duct 2 at a flow rate of 10 l/m and a supply pressure of 0.1 kg/cm$^2$.

The low supply pressure of the argon naturally raises the question how the rod 1 can be immersed in the molten steel to any substantial depth without the molten steel backing up into duct 2. The explanation is that in practice, the lower end of the rod is preferably quite close to nozzle S, e.g. 1 to 5 mm. thereabove, with the result that the relatively rapid flow of molten steel through the relatively narrow annular gap thus provided maintains the lower end of rod 1 open to gas flow therefrom by eduction. The drawing is of course only schematic and so this gap is exaggerated in the drawing for clarity of illustration.

Feeder 5 continuously feeds powder at a flow rate of 2 kg/min, whose weight percent composition is as follows:

| | |
|---|---|
| Carbon | 0.88% |
| Silicon | 0.68% |
| Manganese | 0.79% |
| Sulfur | 0.018% |
| Phosphorous | 0.018% |
| Balance essentially iron | |

The particle size of the added powder fell in the range 0.5–1 mm.

The continuously cast ingot was not significantly altered in composition by the addition of the powder, and was free from breakouts and relatively free from other defects arising from inadequate ingot temperature control and was of uniformly high quality throughout.

EXAMPLE II

Example I was repeated, except that the powder alloy contained also 2% by weight aluminum. Thus, the powder served not only to cool the steel, but also correspondingly to increase the aluminum content of the continuous casting.

Although the present invention has been described and illustrated in connection with a preferred embodiment, it is to be understood that modifications and variations may be resorted to, without departing from the spirit of the invention, as those skilled in this art will readily understand. Such modifications and variations are considered to be within the purview and scope of the present invention as defined by the appended claims.

What we claim is:

1. A method of adding steel powder to steel during the continuous casting of steel, comprising positioning a receptacle above a continuous casting mold with an outlet of the receptacle continuously feeding molten steel to the mold, maintaining a quantity of molten steel in the receptacle above the outlet from the receptacle to the mold, injecting into said molten steel in the receptacle beneath the surface thereof and adjacent said outlet, a continuous stream of inert gas containing steel powder in the amount of 0.5 to 3% by weight of the steel being cast and having a grain size of from 0.02 mm. to 3.0 mm, and immersing said outlet of the receptacle into the molten steel in the continuous casting mold, to a substantial depth below the surface of said molten steel in said mold.

* * * * *